US008657643B2

(12) United States Patent
Perez

(10) Patent No.: US 8,657,643 B2
(45) Date of Patent: Feb. 25, 2014

(54) NURSING BRA

(76) Inventor: Carlos F. Perez, Bartlett, NM (US)

( * ) Notice: Subject to any disclaimer, the term of this patent is extended or adjusted under 35 U.S.C. 154(b) by 355 days.

(21) Appl. No.: 13/111,174

(22) Filed: May 19, 2011

(65) Prior Publication Data

US 2012/0129427 A1 May 24, 2012

Related U.S. Application Data

(60) Provisional application No. 61/346,239, filed on May 19, 2010.

(51) Int. Cl.
*A41C 3/00* (2006.01)

(52) U.S. Cl.
USPC ..... 450/36; 450/54

(58) Field of Classification Search
USPC ..... 450/36–38, 54–58, 92, 93; 2/267, 268; 604/385.07, 393
See application file for complete search history.

(56) References Cited

U.S. PATENT DOCUMENTS

| | | | | |
|---|---|---|---|---|
| 1,989,382 | A * | 1/1935 | Schnaittacher | 604/346 |
| 2,748,771 | A | 6/1956 | Richards | |
| 2,767,402 | A | 10/1956 | Pauk | |
| 5,024,628 | A | 6/1991 | Sanchez | |
| 6,074,273 | A | 6/2000 | Turner et al. | |
| 6,346,027 | B1 | 2/2002 | Merkovsky | |
| 6,659,841 | B2 * | 12/2003 | Raimondo | 450/36 |
| 7,081,034 | B1 * | 7/2006 | Zoellner | 450/54 |
| 7,448,936 | B1 * | 11/2008 | Kemp-Dorsey | 450/36 |
| 7,806,748 | B2 * | 10/2010 | Richardson | 450/61 |

* cited by examiner

*Primary Examiner* — Gloria Hale
(74) *Attorney, Agent, or Firm* — The Adams Law Firm

(57) ABSTRACT

A nursing bra comprising a mesh fabric pocket formed inside of a bra cup for receiving a pad of absorbent material, the pocket interior member having an opening proximate the weaver's breast nipple permitting direct contact between the nipple and pad.

24 Claims, 4 Drawing Sheets

NURSING BRA

RELATED APPLICATION

This application claims the benefit of U.S. Provisional Patent Application Ser. No. 61/346,239 filed May 19, 2010.

FIELD OF THE INVENTION

This invention relates to a woman's brassiere ("bra") for use by nursing mothers but may also be used in any circumstances in which a pad is used to absorb discharge from a woman's breast or emollients that may be applied for medical reasons on the nipple area of the breast.

BACKGROUND AND SUMMARY OF THE INVENTION

It is well known that women nursing a child, after breast feeding, may experience leakage of milk. Bras for nursing mothers may be provided with an absorbent pad to be placed within the cup to cover the nipple and to absorb the discharge. Examples of prior art nursing bras include: U.S. Pat. No. 6,074,273 (Turner), U.S. Pat. No. 2,748,771 (Richards), U.S. Pat. No. 6,659,841 (Raimondo), U.S. Pat. No. 6,346,027 (Merkovsky), U.S. Pat. No. 2,767,402 (Pauk), U.S. Pat. No. 7,448,936 (Kemp-Dorsey), U.S. Pat. No. 7,081,034 (Zoeliner), U.S. Pat. No. 1,989,382 (Schnaittacher) and U.S. Pat. No. 5,024,628 (Sanchez).

The present invention solves many of the problems associated with prior art nursing bras. To mention a few, the embodiment here disclosed provides a removable and disposable absorbent pad that is inserted and held in a pocket formed on the inside of the bra while the bra is worn and while the bra cup has been lowered to expose the breast during feeding. It is not necessary to remove the pad from the bra during feeding avoiding loss or contamination of the pad. In addition, the pad is positioned in the pocket to cover an opening formed in the fabric that defines the inner member of the pocket to directly expose and contact the nipple of the breast with the absorbent pad; the opening is located off-center from the vertical axis passing through the center of the cup, toward the center of the bra.

The present invention comprises a nursing bra, and a method for making a nursing bra. The bra comprises two cups that receive and hold the breast of the woman. The two cups are attached at their adjoining edges. The opposite edges of the bra cups include torso straps that hold the bra in place in addition to shoulder straps in some embodiments. Each cup comprises a first flexible fabric member that covers the inner surface of the cup, conforms to the shape of the cup, and is secured along the peripheral edge of the cup; a second member secured to the cup along a portion of the periphery of the cup so as to define an entry to a pocket formed by the first and second members, the second member having an opening so as to expose the nipple of the breast, the opening being off-center from the vertical axis of the cup toward the center of the bra; and an absorbent pad of a size sufficient to cover the opening in the second member, the pad being removably inserted and held in position to cover the nipple and in contact therewith.

DESCRIPTION OF THE PREFERRED EMBODIMENT

Although the disclosure hereof is detailed and exact to enable those skilled in the art to practice the invention, the physical embodiment disclosed is merely exemplary of the invention which may be embodied in other specific structures. While the preferred embodiment is described in detail, such details may be changed without departing from the invention, which is defined by the claims.

Figure 1:
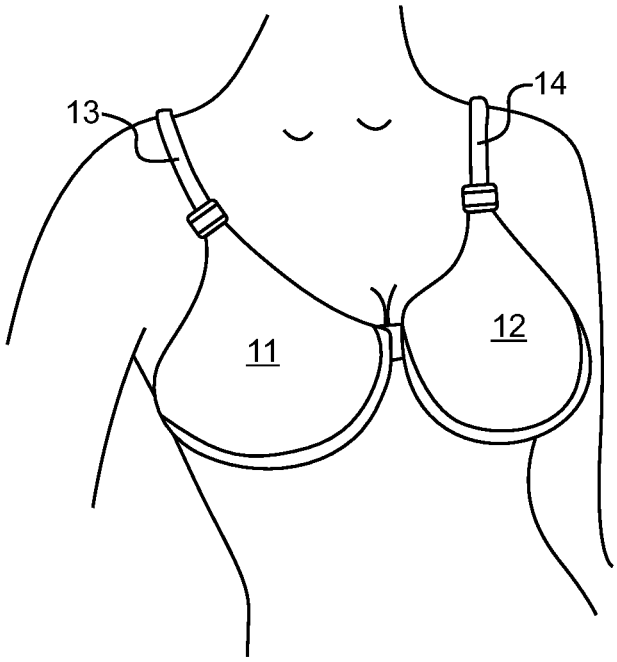
FIG. 1 shows an embodiment of the present invention worn by a nursing female.

FIG. 1 shows the embodiment of the bra 10 as worn by a woman and comprises two cups, 11, 12, such as the cups sold by Dritz Notions, molded, polyester, tricot-covered latex form, such as Dritz sew-in-cups and in this embodiment, two shoulder straps 13, 14. It is to be understood that the bra may be configured without shoulder straps.

Figure 2:
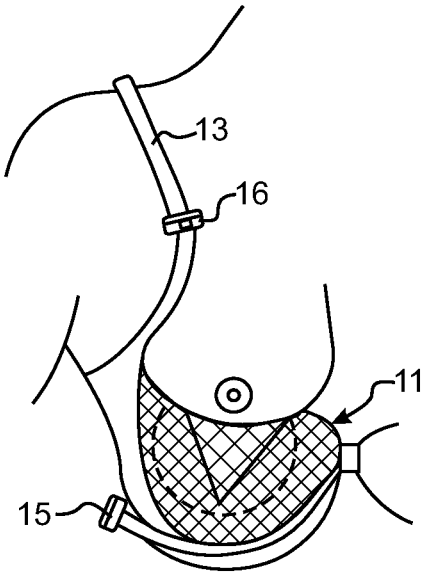
FIG. 2 shows one breast of the woman exposed by lowering the cup to permit infant feeding.
Figure 3:
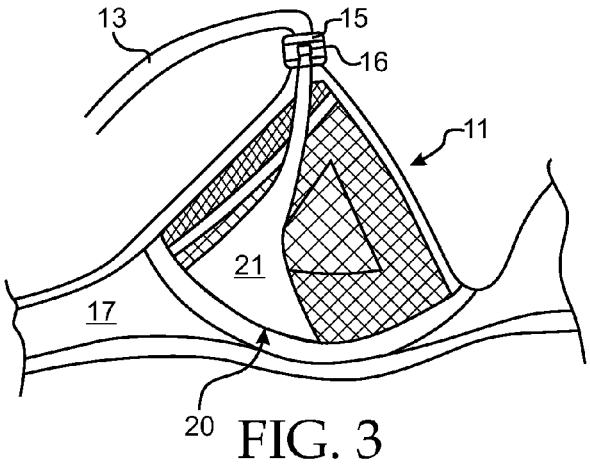
FIG. 3 is a rear view of the bra cup of the bra in FIG. 1 showing the bra cup in the condition as worn.
Figure 4:
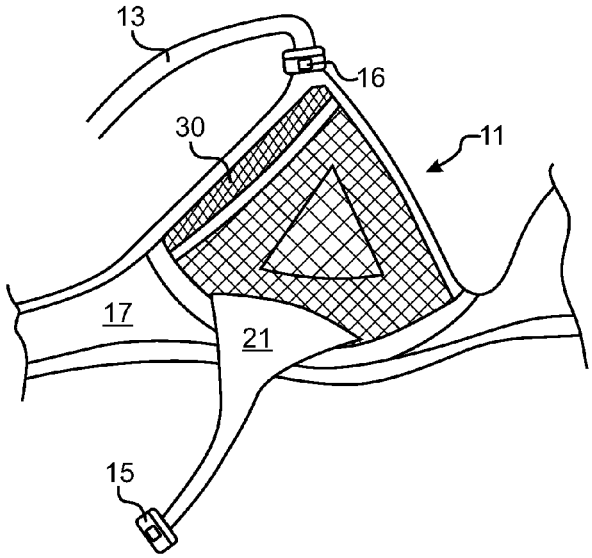
FIG. 4 is another rear view of the bra of FIG. 3 showing the flap that is used to retain the bra in position during feeding, the strap folded down for illustrative purposes.

FIG. 2 illustrates the bra cup 11 that covers the right breast of the woman shown in a position suitable for feeding an infant where the bra cup has been folded downwardly by detaching the fastener component 15 which has been detached from its mating fastener component 16. FIG. 2 shows the internal or back structure of the bra cup 11 which is more particularly shown in FIG. 3. Turning to that figure, it will be seen that the cup 11 has a generally triangular shape which, at its apex, has a fastener comprising fastener components 15, 16 and a portion of a torso strap 17 that surrounds the back of the woman, the torso strap 17 having an attachment member at its free end which may be used to secure the free end of torso strap 17 to a like torso strap 18 (not shown) that is attached to breast cup 12 in a manner well known in the art. In this particular embodiment, the means for lowering the cup during feeding comprises a flap 20 that is sewn or otherwise secured at its lower edge 21 to the lower rounded edge of cup 11 and lies within the breast cup 11 when worn. At its upper end, flap 21 is secured to fastener component 16 which may be permanently or removably attached to strap 13. When feeding, and the cup is in the position as shown in FIG. 2, it will be seen that the fastener component 16 remains attached to the strap 13, thereby maintaining the bra in place while the cup is lowered. For illustrative purposes, bra cup 11 is shown in FIG. 4 with the flap 21 folded downwardly, the fastener component 15 having been detached from fastener component 16. It is to be understood that various configurations or structures for maintaining the bra in place when nursing may be utilized as will be known to those skilled in the bra-making art, including but not limited to the bras shown and described in the above-identified patents. Similarly, the fastener shown is only exemplary and other clips, fabric, hook and loop or other types of fastener may be used.

Figure 5:
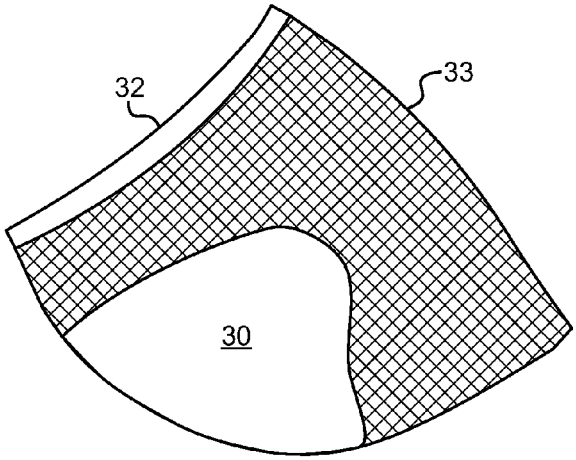
FIG. 5 is a view of a first member attached to and positioned against the inner surface of the bra cup.

Referring now to FIG. 4, it will be seen that within the cup, and conforming thereto, there is a first member 30, in the form of a soft, flexible, mesh material, that is sewn around its peripheral edge so that it lies in contact with the rear surface of the cup 11. The mesh material is a polyester weave or other type of liquid resistant synthetic woven material with the size of the opening being approximately 0.25-0.80 mm. The inner member 30 is shown in FIG. 5 prior to being attached to cup 11. It will there be seen that the mesh material has a periphery that may be approximately defined as a curved lower edge 31, and two substantially straight or slightly curved edges 32, 33 which are shown curved to illustrate that the fabric, once attached to the cup, will conform to the edges of the cup. The first member 30 is secured along its peripheral edges 31, 32 and 33 to the peripheral edges of cup 11 with a seam or strip of material that is folded and sewn along each edge in a manner well known in the clothes-making art. It will be understood by those of skill in the art that there are various methods of attachment of the edges of a mesh material, such as 30, to another material, such as that of the cup.

Figure 6:
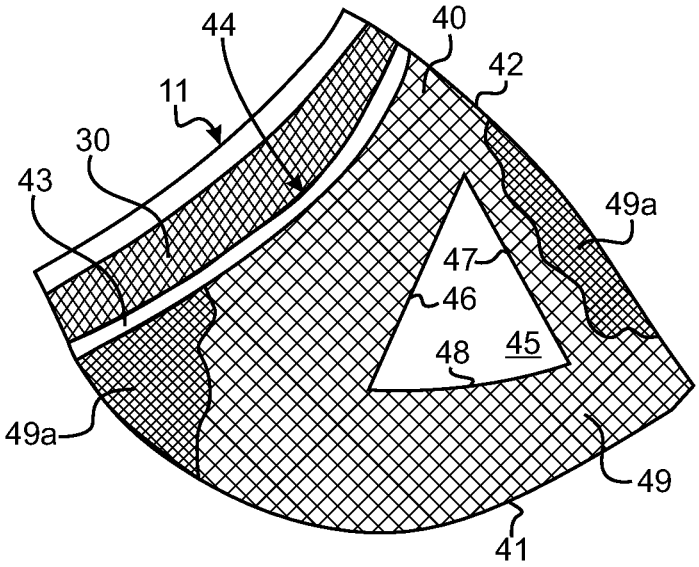
FIG. 6 is a second member that is positioned inwardly of the first member in contact with the woman's breast and is attached to the cup to provide an entry to a pocket.
Figure 7:
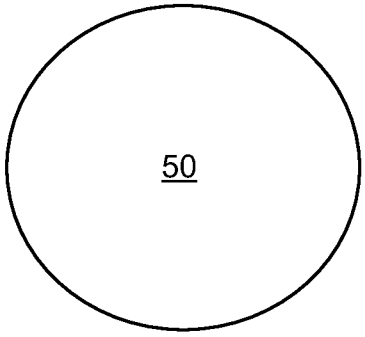
FIG. 7 is an absorbent pad that is installed in the pocket.

Referring now to FIGS. 4 and 6, there is shown a second member 40 similar in shape to the first member 30 but slightly shorter along one edge for the reason to be explained. Second member 40 is shown overlying first member 30. Second member 40 has a peripheral edge that is rounded as at 41, and has a straight inner (toward the center of the bra) portion 42. Peripheral portions 41, 42 are attached to first member 30 peripheral edges 31, 33 and/or to the periphery of the cup 11. However, second member 40 at its peripheral edge comprises a braided elastic 43 is displaced laterally from the edge of cup 11 and is not sewn to either first member 30 or cup 11 thereby creating a slot 44 into a pocket formed between the first and second layers for receiving an absorbent pad 50 as shown in FIG. 7 made from a soft, loosely-matted, cellulosic material, or cotton or other moisture absorbing material. It will be understood by those of skill in the art that various absorbent materials may be used for pad 50.

As will be seen in FIG. 6, second member 40 has an opening 45 such that when absorbent pad 50 is inserted in the pocket 44 formed by first member 30 and second member 40 the nipple of the breast of the wearer is in direct contact with the absorbent pad 50. In the embodiment shown, the opening is substantially triangular, approximately 3" along each edge, but it will be apparent to those of ordinary skill in the art that the opening could have various geometric configurations such as square, round, rectangular, trapezoidal, or irregular, but a triangular shape is preferred. In the triangular embodiment, the opening 45 has peripheral edges 46, 47 and 48. If second member 40 was formed from a single layer of mesh material, the peripheral edges 46, 47 and 48 would be rough and would cause irritation of the portion of the breast that is in contact with the raw edge. Accordingly, in this embodiment, member 40 is formed from two layers of mesh material 49 and **49*a* as clearly seen in FIG. 6. After the opening 45 is cut in layers 49 and 49*a*, the material is stitched along the peripheral edges 46, 47 and 48 and after stitching, is turned inside out so that the stitching is within, or in between, layers 49 and 49*a***. This provides a smooth, finished, non-irritating edge. It will be understood that there are various methods that may be used to mitigate a sharp or raw edge of clothing material that may irritate are well known in the seamstress, tailoring and clothes-making art.

Figure 8:
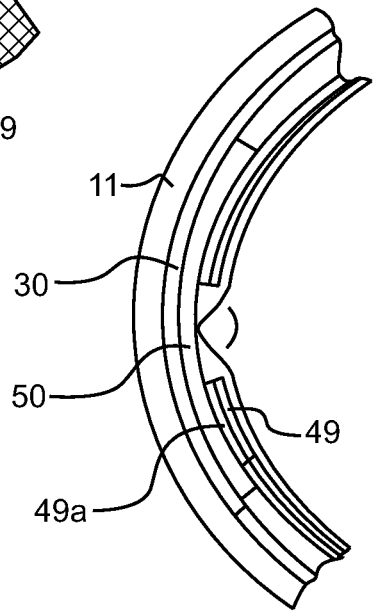
FIG. 8 is a cross-sectional view of a portion of the bra when worn.

To assist in understanding the lay up of the various members that comprise the assembled bra 10, there is shown in FIG. 8 a cross-sectional view showing the external layer comprising the cup 11 which may be formed of various materials. Inward of cup 11 is first member 30, and further inward is absorbent pad 50. Still further inward is second member 40 comprising layers of mesh material 49, **49*a*. The surface of the woman's breast excluding the nipple bears against the inner surface of layer 49 of second member 40 while the nipple bears against pad 50**.

Figure 9:
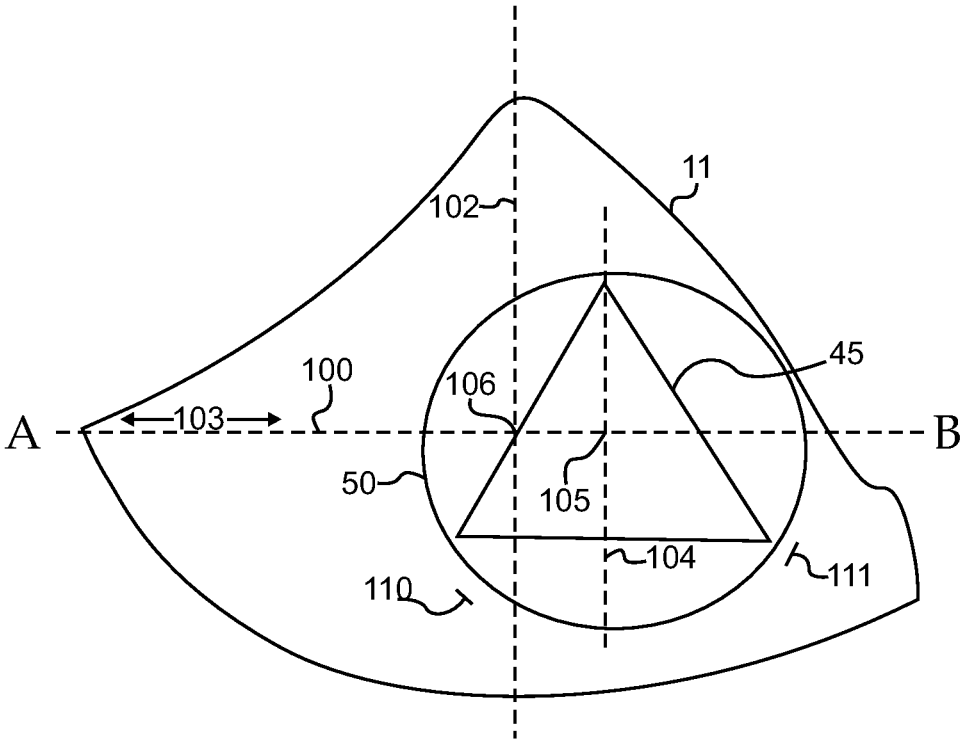
FIG. 9 is a diagrammatic sketch to illustrate proper positioning of the opening in the second member.

An important aspect of the invention, as shown in the embodiment, is the proper layout for the opening 45 in relation to the cup 11 and the pad 50. In FIG. 9, there is shown a layout drawing for the materials to be assembled into bra 10, specifically showing the outline of the cup 11, the outline of the opening 45, and the outline of the pad 50. To properly position the opening 45 relative to the shape of the cup 11, an approximately horizontal line 100 along the widest portion of the cup and a vertical line 102 is drawn over the cup shape 11 as shown. A measurement 103 is then taken between points A and B on the horizontal line 100, typically 8 inches, with a range of 6-½-10 inches. Then an additional vertical axis through the apex of the triangle 104 is constructed and is positioned preferably one inch, with a range of 10% to 20% of measurement 103, toward the center of the bra. The center 105 of the triangular outline of the opening 45 is found by bifurcating the triangle vertical axis 104 between the apex and the base of the triangle. That center will be the center for the pad 50 by providing, by stitching or the like, two anchoring points 110 and 111 horizontally spaced apart near the lower edge of the cup approximately 1" below the base of the triangular opening 45 (not shown in other figures) between the first and second members thereby positioning the pad 50 vertically with respect to the horizontal axis 100.

The rationale for this placement of the opening 45, specifically its center 105, is that the nipple of the breast of a woman is not concentric with the center 106 of the cup 11. Because it is important that the nipple of the breast is in contact with the absorbent pad 50, the nipple must be approximately at the center 105 of the opening 45. Of course, bra cups and women's breasts vary in shape and configuration and a precise centering of the nipple with the center 105 of the opening is not necessary because there is a certain amount of tolerance with respect to this positioning.

The advantages of the invention, as implemented in the embodiment shown and described, will be obvious to those having ordinary skill in the art. It provides an absorbent pad to absorb lactation from a mother's breast who is breast feeding and/or upon termination of the breast feeding process. The absorbency is assured by providing an opening between the nipple of the breast and the absorbent pad. The absorbent pad is trapped in a pocket of the mesh material which will wick the liquid absorbed by the pad over the area surrounding the opening on both the front and rear surfaces of the absorbent pad thereby more rapidly evaporating the liquid thereby providing greater comfort to the wearer. Another important advantage is the positioning of the opening relative to the cup so as to approximate the location or relationship between the breast nipple and the opening and pad. This configuration is performed by a layout as shown in FIG. 9. Additionally, the pad is contained in the pocket at all times, during wearing, as well as during nursing, and thus the pad does not have to be removed from the bra during nursing and is unlikely to be lost or contaminated.

Certain novel features and components of this invention are disclosed in detail in order to make the invention clear in at least one form. However, it is to be understood that the invention as disclosed is not necessarily limited to the embodiment shown, including its details of configuration, shape, material and the like since it will be apparent that various modifications and changes may be made without departing from the spirit of the invention.

I claim:

1. A nursing bra to be worn by a woman for supporting the woman's breasts, each breast having a nipple area, said bra comprising:

two bra cups connected by a center member, each of said cups having a periphery and a center comprising;

a first thin, flexible, mesh material member that covers the inner surface of said cup, conforms to the shape of the cup, and is secured along the entire periphery of said cup;

a second member including first and second layers of thin, flexible mesh material, said second member secured to the cup over a substantial portion but less than the entire periphery of said cup defining a slot for a pocket between the first and second members, said second member having an opening including a vertical center and an edge for exposing the entire nipple area of the breast of the wearer, the center of said opening located off-center from the center of the cup; and an absorbent pad removably inserted and held in said pocket, said pad sized so as to be at least co-extensive with said opening and in contact with the breast nipple of the wearer.

2. The nursing bra of claim 1 wherein an internal seam of the two layers defines an opening edge.

3. The nursing bra of claim 1 wherein said opening is located toward the center member of the bra relative to the center of the cup.

4. The nursing bra of claim 3 wherein said center of said opening is located at a distance from the center of said cup equal to about twenty percent of the distance measured across the cup along a horizontal line located at the vertical center of said opening.

5. The nursing bra of claim 1 wherein said opening is triangular.

6. The nursing bra of claim 1 wherein said pad is round.

7. The nursing bra of claim 1 additionally including at least two horizontally spaced apart anchoring points through said first and second members located below said opening for supporting said pad in a position that covers the entire opening.

8. The nursing bra of claim 1 wherein said cup includes at least a bottom portion and two side portions and said pocket slot is at the side of the cup that is away from the center member of the bra.

9. The nursing bra of claim 1 wherein said pad is disposable.

10. The nursing bra of claim 1 wherein said pad is made of absorbent cotton.

11. The nursing bra of claim 1 wherein said first member is a fine mesh material.

12. The nursing bra of claim 1 wherein said two layers of said second member are made of a fine mesh material.

13. A nursing bra to be worn by a woman for supporting a woman's breasts, each breast having a nipple area, comprising:

two bra cups each cup having top, bottom and two straight side peripheral edges, said side edges meeting at an apex at the top edge, said cup having a center, and said cups attached by a center member;

two torso straps having proximal and distal ends, each strap proximal end attached at one edge of each of said cups, said straps having means for interconnecting the distal ends of said straps;

two shoulder straps each attached at one end to one of said torso straps and at the opposite end to a flap having lower and upper portions, a lower portion of each of said flaps secured along the bottom edge of each of said cups and the upper portion of said flap removably attached to the top edge of said cup whereby the cup is selectively lowerable so as to expose the breast during feeding;

each said cup having a convex shape;

a first thin, flexible, mesh material member that covers the inner surface of said cup, conforms to the shape of the cup, has a generally upwardly facing curved bottom section, and two generally straight edges intersecting at an angle so as to define the upper section of said cup, the apex of said angle at the removable attachment point, said first member secured along the entire periphery of said cup;

a second member of thin, flexible mesh material, said second member secured to the cup along the bottom periphery of said cup, and along the inner straight peripheral edge of the upper portion of said cup, outer straight periphery unsecured so as to define a slot for a pocket formed between the first and second members, said second member having an opening including a vertical center for exposing the entire nipple area of the breast, the vertical center of said opening located off-center from the center of the cup; and an absorbent pad removably inserted and held in said pocket, said pad sized so as to be at least co-extensive with said opening and in contact with the breast nipple.

14. The nursing bra of claim 13 wherein said opening edge is smooth.

15. The nursing bra of claim 14 wherein said opening is located toward the center of the bra.

16. The nursing bra of claim 15 wherein said center of said opening is located at a distance from the center of said cup equal to about twenty percent of the distance measured across the cup along a horizontal line located at the vertical center of said opening.

17. The nursing bra of claim 16 wherein said opening is triangular.

18. The nursing bra of claim 17 wherein said pad is round.

19. The nursing bra of claim 18 wherein each cup additionally includes at least two horizontally spaced apart anchoring points through said first and second members said anchoring points located below said opening for supporting said pad in a position that covers the entire opening.

20. The nursing bra of claim 19 wherein said pocket slot is at the side of the cup.

21. The nursing bra of claim 20 wherein said pad is disposable.

22. The nursing bra of claim 21 wherein said pad is made of absorbent cotton.

23. The nursing bra of claim 22 wherein said first member is a fine mesh material.

24. A method of making a nursing bra to be worn by an expecting woman comprising the steps of:

forming a pair of convex cups, each cup having a periphery including a bottom peripheral edge and a center, for supporting the breasts of the woman, each breast of the woman having a nipple area and with respect to each cup;

attaching each cup to a center member;

sewing a first, thin, flexible mesh material member along the entire periphery the cup;

sewing a second, thin, flexible mesh material member to the first member and/or said cup along a portion of the periphery of the cup and first member to define a pocket between the first and second members and a slot into the pocket.

cutting an opening in said second member for exposing the nipple of the wearer's breast, the position of the opening being vertically spaced from the bottom peripheral edge of said cup, and horizontally spaced by;

measuring the horizontal distance between opposite peripheral edges of said cup, and centering the opening approximately twenty percent from the vertical center of the cup toward the center member of the bra; and inserting and positioning a removable pad of absorbent material in the pocket so as to completely cover the opening.

* * * * *